US011027550B2

(12) United States Patent
Hagen et al.

(10) Patent No.: US 11,027,550 B2
(45) Date of Patent: Jun. 8, 2021

(54) SPITTING OFFSETS FOR PRINTHEADS

(71) Applicant: Hewlett-Packard Development Company, L.P., Spring, TX (US)

(72) Inventors: Travis Timothy Hagen, Vancouver, WA (US); Jeffrey Neal Daley, Vancouver, WA (US); Murthy Srikantom, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 32 days.

(21) Appl. No.: 16/456,364

(22) Filed: Jun. 28, 2019

(65) Prior Publication Data

US 2020/0406623 A1 Dec. 31, 2020

(51) Int. Cl.
*B41J 2/165* (2006.01)
*B41J 2/045* (2006.01)

(52) U.S. Cl.
CPC ..... *B41J 2/16517* (2013.01); *B41J 2/0451* (2013.01); *B41J 2002/1657* (2013.01)

(58) Field of Classification Search
CPC .... B41J 2/16517; B41J 2/1652; B41J 2/0451; B41J 25/308; B41J 2/155
USPC ..... 347/8, 12, 13, 32
See application file for complete search history.

(56) References Cited

U.S. PATENT DOCUMENTS

| | | | | |
|---|---|---|---|---|
| 6,398,358 | B1 * | 6/2002 | Miyake | B41J 2/16579 226/45 |
| 9,221,261 | B2 | 12/2015 | Love et al. | |
| 2004/0160472 | A1 | 8/2004 | Khalid et al. | |
| 2007/0057981 | A1 | 3/2007 | Lee et al. | |
| 2012/0139982 | A1 | 6/2012 | Abe | |
| 2018/0297382 | A1 | 10/2018 | Mackenzie et al. | |

* cited by examiner

*Primary Examiner* — An H Do
(74) *Attorney, Agent, or Firm* — HP Inc. Patent Department

(57) ABSTRACT

An example of an apparatus is provided. The apparatus includes a printhead to dispense a first print fluid and a second print fluid. In addition, the apparatus includes a first nozzle disposed on the printhead. The first nozzle is to eject a first plurality of drops of the first print fluid. The apparatus also includes a second nozzle disposed on the printhead. The second nozzle is offset from the first nozzle by an offset distance along a relative direction of media travel. The second nozzle is to eject a second plurality of drops of the second print fluid. Furthermore, the apparatus includes a textile to receive the first plurality of drops and the second plurality of drops. The textile is to be moved relative to the printhead by the offset distance between ejection of the first plurality of drops and the second plurality of drops.

15 Claims, 8 Drawing Sheets

SPITTING OFFSETS FOR PRINTHEADS

BACKGROUND

Printing devices are often used to present information. In particular, printing devices may be used to generate output that may be easily handled and viewed or read by users. Accordingly, the generation of output from printing devices from electronic form is used for the presentation and handling of information. Some printing devices use print fluids to generate output. In such printing devices, the print fluids are generally applied to a medium. Print fluids may be applied to a medium via a printhead having a plurality of nozzles or dies that may eject the print fluid.

BRIEF DESCRIPTION OF THE DRAWINGS

Reference will now be made, by way of example only, to the accompanying drawings in which.

DETAILED DESCRIPTION

Some printing devices use fluids to generate output. For example, printing devices may generate documents, images, or three-dimensional objects. In such printing devices, fluid delivery systems are generally used to deliver a liquid from one part of the printing device, such as a reservoir to a printhead where the fluid is subsequently ejected through a nozzle onto a media, such as paper, to generate an image. Over time, the health of the nozzle degrades. For example, the nozzle health may degrade and become less responsive or completely inoperable due to mechanical degradation. In other examples, the nozzle health may degrade due to a build-up of deposits around the nozzle, such as dried print fluid, dirt, dust particles, and/or fibers released from a print media.

As deposits build up on a nozzle, a cleaning procedure may be used to clean the nozzle to restore it to good health. In order to reduce nozzle clogs and to restore nozzles to a healthy state for subsequent printing operations, nozzles may be periodically exercised by ejecting a number of ink drops. This may be carried out upon detection of an unhealthy nozzle or at fixed intervals of time. The process of exercising the nozzle in such a manner may be commonly referred to as "health spitting" or simply as "spitting."

In some examples, the health spitting occurs over a waste material, such as a textile. The waste material may also be used to physically contact the nozzle to remove any buildup of contaminants on the nozzle. Accordingly, the waste material, such as a textile, is to be cleaned to reduce the risk of further contamination.

In the examples described below, an apparatus is provided that may be used to keep the nozzles clean and relatively free from contaminants. In particular, the apparatus provides a manner by which the health spitting process may be carried out on a reduced amount of textile or other waste material. Accordingly, the apparatus may be used to reduce costs as well as the consumption of single use components.

Figure 1:
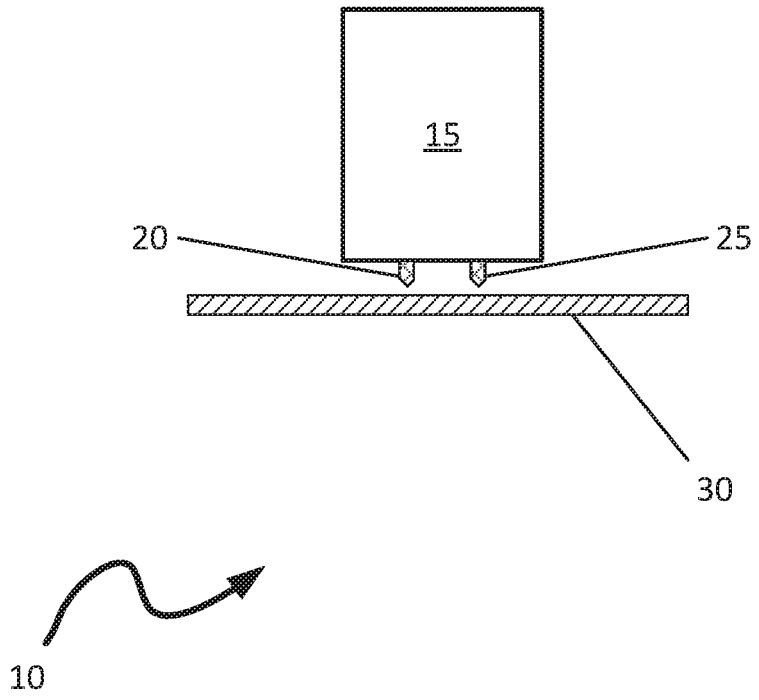
FIG. 1 is a schematic representation of an example apparatus to reduce textile use during health spitting procedures of a printhead.

As used herein, any usage of terms that suggest an absolute orientation (e.g. "top", "bottom", "vertical", "horizontal", etc.) are for illustrative convenience and refer to the orientation shown in a particular figure. However, such terms are not to be construed in a limiting sense as it is contemplated that various components will, in practice, be utilized in orientations that are the same as, or different than those described or shown Referring to FIG. 1, an apparatus 10 to reduce textile use during health spitting procedures of a printhead 15 is generally shown. In the present example, the apparatus 10 may be part of a printing device to maintain and/or improve the health of nozzles on the printhead 15. Accordingly, the printing device may include additional components for delivering print fluid to print media as well as for positioning the print media within the printing device. The apparatus 10 may include additional components, such as various controllers, and additional interfaces or displays to interact with a user or administrator. In other examples, the apparatus 10 may be integrated with the control systems of the printing device such that interfaces and controllers are managed by the printing device or another computing device. Furthermore, in some examples, the apparatus 10 may be used during the printing process to clean the nozzles between print jobs or during the print job. In other examples, the apparatus 10 may be used upon user request. In the present example, the apparatus 10 includes a printhead 15, nozzles 20 and 25, and a textile 30.

The printhead 15 is to dispense print fluid in general. For example, the printhead 15 may dispense print fluid onto media to generate an output image. The manner by which the printhead 15 dispenses the print fluid is not limited. For example, the printhead 15 may eject a plurality if drops of print fluid. In the present example, the printhead 15 may eject drops of print fluid under pressure such that the drops travel along a drop path from the printhead 15 through the air to a target, such as to a print media or to the textile 30 as discussed in greater detail below. The source of the print fluid provided to the printhead 15 is also not limited. For example, the printhead 15 may receive print fluid from a tank, reservoir, or other print fluid source. The printhead 15 may use a thermal ink jet or a piezo ink jet mechanism to push the print fluid from the print fluid source to the target. In other examples. the printhead 15 may include a motor and/or vacuum to draw the print fluid via a fluid line. In further examples, the printhead 15 may use capillary action to draw the print fluid or the printhead 15 may include a tank such that the print fluid is delivered to the printhead 15 by gravity. In some examples, the printhead 15 may include multiple sources of print fluid where each source of print fluid may provide a different print fluid. For example, the printing device may have separate tanks of print fluid for different colors, such as black, cyan, magenta, and yellow. The print fluid from each source may be directed to different nozzles on the printhead 15. Accordingly, during a printing operation, the printhead 15 may dispense a mixture of different colors to deposit on the media depending on the output image.

In some examples, the printhead 15 may also include various control components such as a controller or microprocessor. The controller or microprocessor may receive electrical signals corresponding to a print job. The printhead 15 may then coordinate the nozzles 20 and 25 to dispense the print fluid onto the textile 30 during the health spitting and to dispense the print fluid onto the print media to generate an image or document. As discussed above, the control components may also be used to control the apparatus 10 and/or other systems for maintaining the health of the nozzles 20 and 25 on the printhead 15 as well as detecting and diagnosing the health of the nozzles 20 and 25 with a diagnosis system, such as an optical drop detection system (not shown).

The nozzle 20 is disposed on the printhead 15 and is to eject a plurality of drops of print fluid onto the textile during a health spitting process to remove contaminants from the nozzle 20. The manner by which the nozzle 20 carries out the health spitting process is not limited. In the present example, the nozzle 20 may eject a plurality of drops of print fluid under high pressure such that the plurality drops push any contaminants lodged near the tip of the nozzle 20 free. In other examples, the nozzle 20 may also receive mechanical assistance to remove contaminants, such as contact from the textile 30 or a brush (not shown).

Figure 2A:
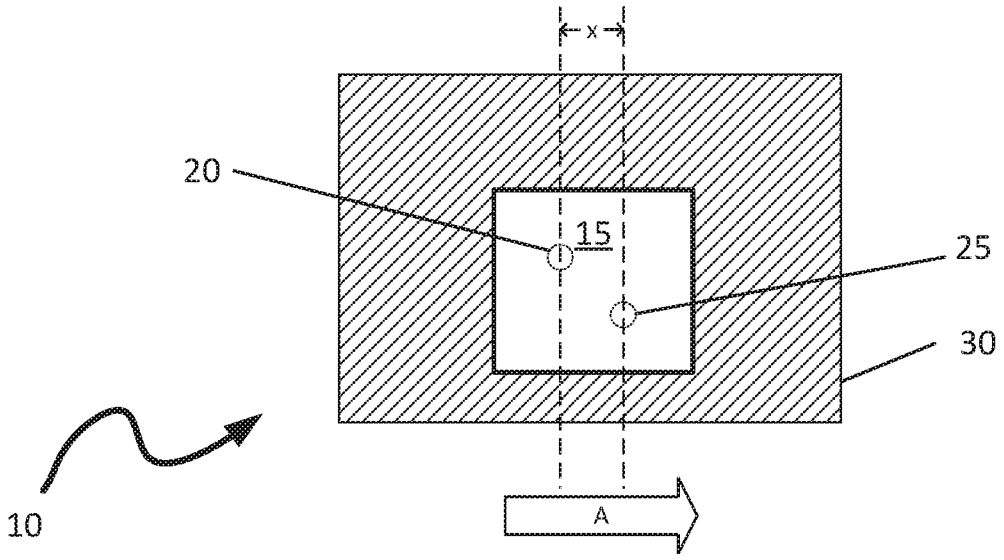
FIG. 2A is a top view of the example apparatus of FIG. 1 with the textile in a first position.

The nozzle 25 is also disposed on the printhead 15 and is to eject a plurality of drops of print fluid onto the textile during a health spitting process to remove contaminants from the nozzle 25. In the present example, the nozzle 25 is to be offset from the nozzle 20 by an offset distance of x as shown in FIG. 2A. The offset distance is not particularly limited. In the present example, the offset distance may be about 10 mm. In other examples, the offset distance may be smaller, such as about 5 mm, or larger, such as about 15 mm. It is to be appreciated that the offset distance is to be measured along a direction of travel of the textile 30, which is the same direction of travel of the print media relative to the printhead 15.

The manner by which the nozzle 25 carries out the health spitting process is not limited and may include the methods discussed above in connection with the nozzle 25. In the present example, the nozzle 25 may eject a plurality of drops of print fluid under high pressure such that the plurality drops push any contaminants lodged near the tip of the nozzle 25 free. In other examples, the nozzle 25 may also receive mechanical assistance to remove contaminants, such as contact from the textile 30 or a brush (not shown).

The textile 30 is to receive the plurality of drops of print fluid from the nozzle 20 and the nozzle 25. In particular, the textile 30 is to absorb the print fluid without allowing the print fluid to run along the surface of the textile 30 or to bounce off the textile 30 to further contaminate the printhead 15 or other parts of the printing device, such as the print media (not shown), which may be adjacent to the textile 30. The material from which the textile 30 may be constructed is not particularly limited. For example, the textile 30 may be cotton, paper, or other material capable of absorbing print fluid.

Figure 2B:
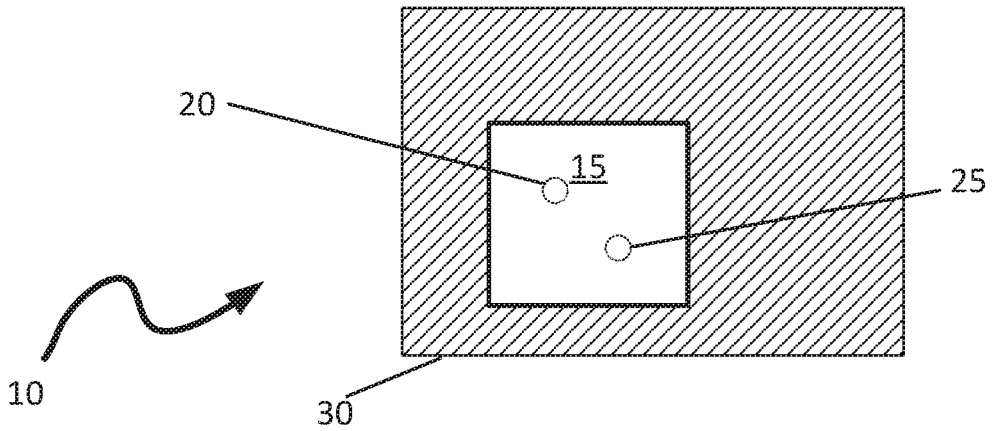
FIG. 2B is a top view of the example apparatus of FIG. 1 with the textile in a second position.
Figure 3A:
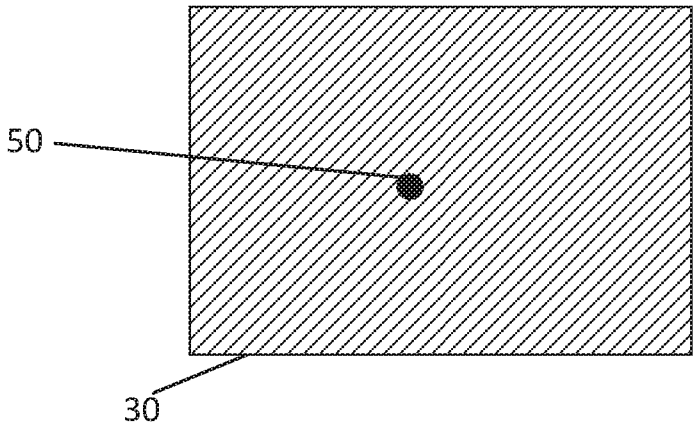
FIG. 3A is a view of the textile after the first health spitting procedure from the first nozzle.
Figure 3B:
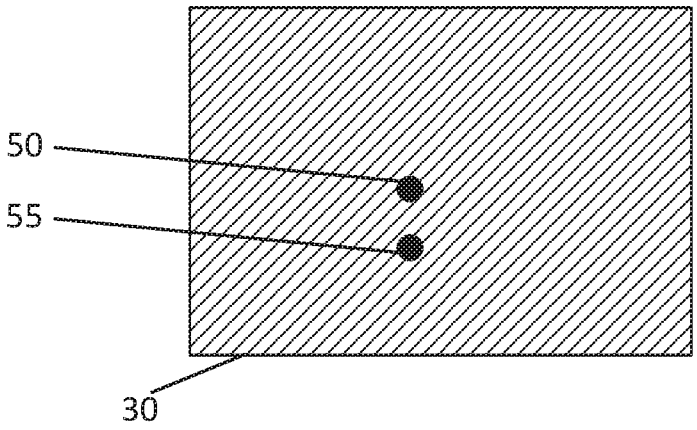
FIG. 3B is a view of the textile after the second health spitting procedure from the second nozzle.

Referring to FIG. 2A, the textile 30 may also be moved relative to the printhead 15 by the offset distance x along the direction of travel indicated by the arrow A to the position shown in FIG. 2B. In particular, the textile 30 may be moved between the ejection of the plurality of drops from the nozzle 20 and the ejection of the plurality of drops from the nozzle 25. It is to be appreciated that the health spitting procedure is to be carried out by the nozzle 20 and the nozzle 25 in sequential order; however, the specific order may be changed. In the present example, the nozzle 20 carries out the health spitting process in the position shown in FIG. 2A to generate a spot 50 as shown in FIG. 3A. After the health spitting process for the nozzle 20 is completed, the textile 30 is moved by the offset distance to the position shown in FIG. 2B in which the nozzle 25 carries out the health spitting process to generate a spot 55 as shown in FIG. 3B. The spot 50 and the spot 55 form a spit pattern. The size of the spot 50 and the spot 55 is not particularly limited and is dependent on the configuration of the printhead 15 as well as the distance the textile 30 is from the printhead 15 and the amount of print fluid ejected during the health spitting process. For example, the width of the spot 50 and the spot 55 may be at least about 1 mm wide in some examples. In other examples, the width of the spot 50 and the spot 55 may be at least about 4 mm wide. Further examples may have non-uniform spot sizes.

Referring to FIG. 3B, in the present example, the spit pattern is formed in a substantially straight line perpendicular to the travel direction of the textile 30 and the print media (not shown). It is to be understood that by forming the spit pattern into a substantially straight line may serve to reduce the amount of textile 30 used during the health spitting procedure for the nozzle 20 and the nozzle 25. In particular, since the width of the textile 30 used in the health spitting procedure of the nozzle 20 and the nozzle 25 is limited to the width of the spot 50 and the spot 55, the subsequent health spitting procedure may be carried out adjacent to the line formed by the spot 50 and the spot 55. Continuing with the example above where the offset distance is about 10 mm and the width of the spot 50 and the spot 55 are about 1 mm each, the apparatus 10 reduces the amount of textile 30 used by up to about 90 percent compared with a process where the nozzle 20 and the nozzle 25 carry out the health spitting simultaneously or without any movement of the textile 30 between their respective health spitting procedures.

The manner by which the textile 30 is moved relative to the printhead 15 is not particularly limited. For example, the textile 30 may be connected to rollers to move the textile 30. In other examples, the textile 30 may be affixed to a moveable substrate. In further examples, the textile 30 may also be stationary and the printhead 15 may be moved instead.

Figure 4:
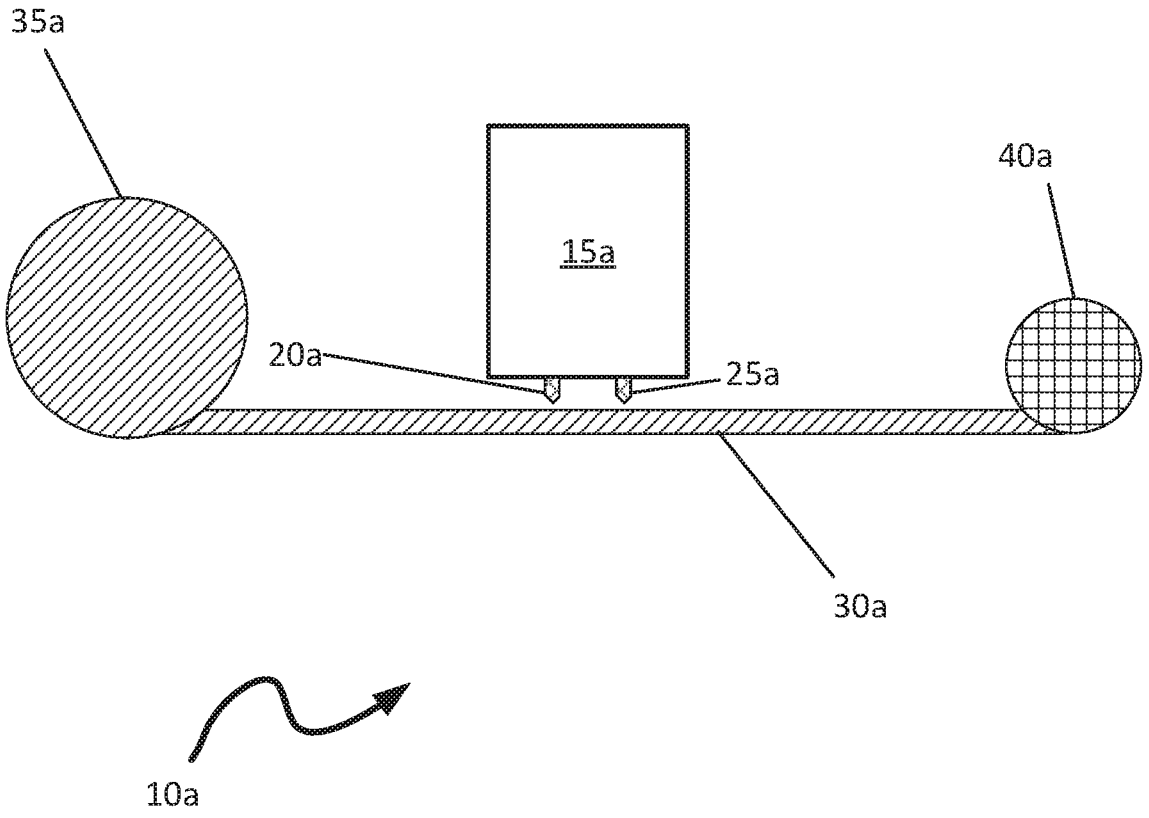
FIG. 4 is a schematic representation of another example apparatus to reduce textile use during health spitting procedures of a printhead.

Referring to FIG. 4, another apparatus 10*a* to reduce textile use during health spitting procedures of a printhead 15*a* is generally shown. Like components of the apparatus 10*a* bear like reference to their counterparts in the apparatus 10, except followed by the suffix "a". In the present example, the apparatus 10*a* includes a printhead 15*a*, nozzles 20*a* and 25*a*, a textile 30*a*, a textile dispenser 35*a*, and a textile collector 40*a* to collect used textile 30*a*.

In the present example, the textile dispenser 35*a* is to dispense the textile 30*a*. The textile dispenser 35*a* is not particularly limited. For example, the textile dispenser 35*a* may include a roll of textile 30*a* that is pulled out to advance the textile 30*a* after each health spitting procedure of the nozzle 20*a* and the nozzle 25*a*. The textile dispenser 35*a* may also take another form in other examples, such as accordion-folded textile 30*a* in a box.

The textile collector 40*a* is to collect used textile 30*a* after it has received print fluid from the nozzle 20*a* and the nozzle 25*a*. The textile collector 40*a* is not particularly limited and may include a roll similar to the textile dispenser 35*a*. In this example, the textile collector 40*a* may receive the textile 30*a* from the textile dispenser 35*a* after the textile 30*a* receives print fluid from the health spitting process. A motor (not shown) may be optionally connected to the textile collector 40*a* to provide rotation to pull the textile 30*a* to provide motion. It is to be appreciated that this may also cause the textile dispenser 35*a* to dispense additional textile 30*a* as it is collected after use.

In summary, the printhead 15*a* may be used in operation to dispense print fluid. For example, the printhead 15*a* may dispense the fluid onto a print media to generate a document or image. In another example, the printhead 15*a* may dispense print fluid to generate an object during a three-dimensional printing process. As the nozzle 20*a* and the nozzle 25*a* of the printhead 15*a* are used, contaminants may build up to affect print quality. At some point, a trigger event occurs that causes the printhead 15*a* to carry out a health spitting procedure to clean the nozzle 20*a* and the nozzle 25*a* to remove contaminants. In the present example, the printhead 15*a* may then be moved over the textile 30*a* as shown in FIG. 4. The health spitting procedure is carried out as described above where the textile 30*a* is moved between the health spitting of the nozzle 20*a* such that the health spitting of the nozzle 25*a* is to be carried out along a straight line. The manner by which the textile 30*a* moves is not limited. In this example, the textile collector 40*a* may be used to pull the textile to form the first position to receive print fluid from the nozzle 20*a* to the second position to receive print fluid from the nozzle 25*a*. In some examples, the textile dispenser 35*a* may also be equipped with a motor to pull the textile 30*a* in the reverse direction. This feature may be used to reposition the textile 30*a* such that the spit pattern may be further packed closer together with a subsequent spit pattern.

Figure 5A:
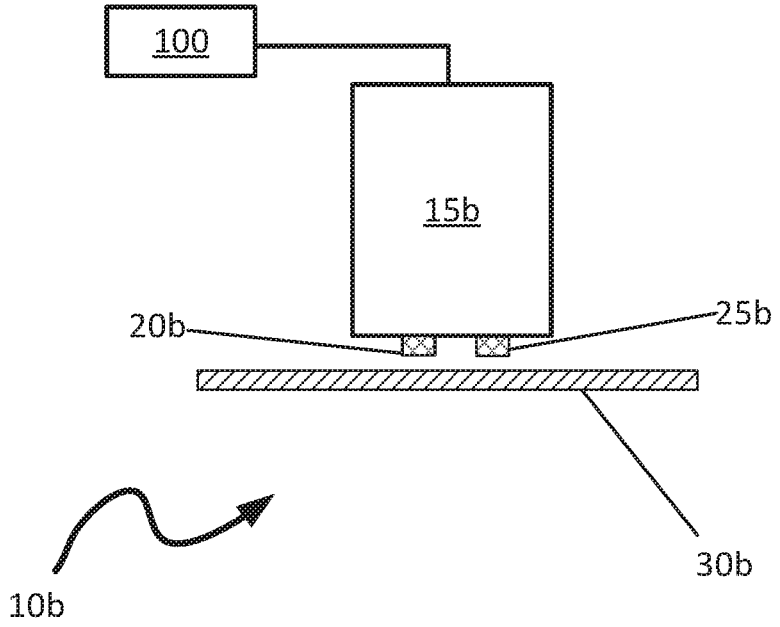
FIG. 5A is a schematic representation of another example apparatus to reduce textile use during health spitting procedures of a printhead.

Referring to FIG. 5A, another apparatus 10*b* to reduce textile use during health spitting procedures of a printhead 15*b* is generally shown. Like components of the apparatus 10*b* bear like reference to their counterparts in the apparatus 10, except followed by the suffix "b". In the present example, the apparatus 10*b* includes a printhead 15*b*, printhead dies 20*b*-1, 20*b*-2, 20*b*-3, 25*b*-1, and 25*b*-2 (as shown in FIG. 5B; generically, these printhead dies are referred to herein as "printhead die 20*b*" or "printhead die 25*b*", and collectively they are referred to as "printhead dies 20*b*" or "printhead dies 25*b*, this nomenclature is used elsewhere in this description), a textile 30*b*, and a controller.

Figure 5B:
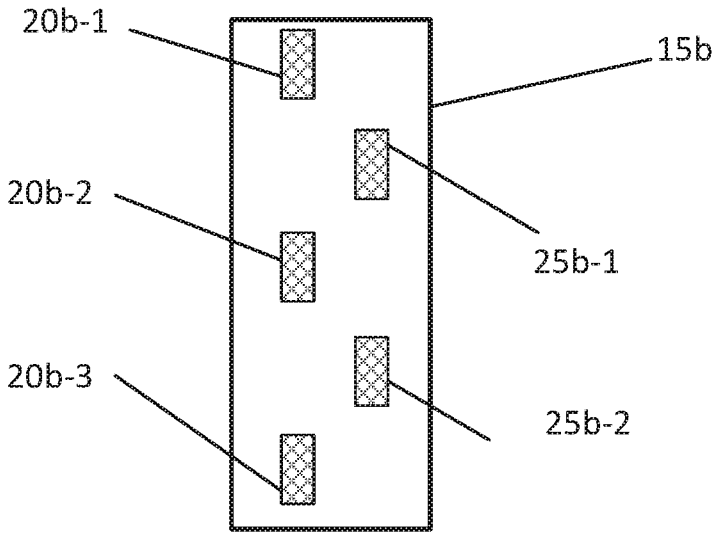
FIG. 5B is a bottom view of the printhead of the apparatus of FIG. 5A.

Referring to FIG. 5B, the apparatus 10*b* includes a plurality of printhead dies 20*b* disposed on the printhead 15*b* and is to eject print fluid during a health spitting process to remove contaminants from the printhead dies 20*b*. In particular, the printhead dies 20*b* are disposed along a line that is perpendicular to a direction which media is to move through a printing device. The manner by which the printhead dies 20*b* eject print fluid is not particularly limited. For example, each printhead die 20*b* may have a nozzle or orifice from which uses a thermal ink jet or a piezo ink jet mechanism to push the print fluid therethrough.

The printhead dies 25*b* are also disposed on the printhead 15*b* and are to eject print fluid onto the textile 30*b* during a health spitting process to remove contaminants from the printhead dies 25*b*. In the present example, the printhead dies 25*b* are disposed along a line parallel to the line of printhead dies 20*b* but offset by an offset distance. The offset distance is not particularly limited. In the present example, the offset distance may be about 10 mm. In other examples, the offset distance may be smaller, such as about 5 mm, or larger, such as about 15 mm. It is to be appreciated that the offset distance is to be measured along a direction of travel of the textile 30*a*, which is the same direction of travel of the print media relative to the printhead 15*a*.

In the present example, contaminants are removed from the printhead dies 20*b* and the printhead dies 25*b* by ejecting a plurality of drops of print fluid under high pressure such that the plurality drops push any contaminants on the printhead dies 20*b* and the printhead dies 25*b* free. In other examples, the printhead dies 20*b* and the printhead dies 25*b* may also receive mechanical assistance to remove contaminants, such as contact from the textile 30*b* or a brush (not shown).

Figure 6:
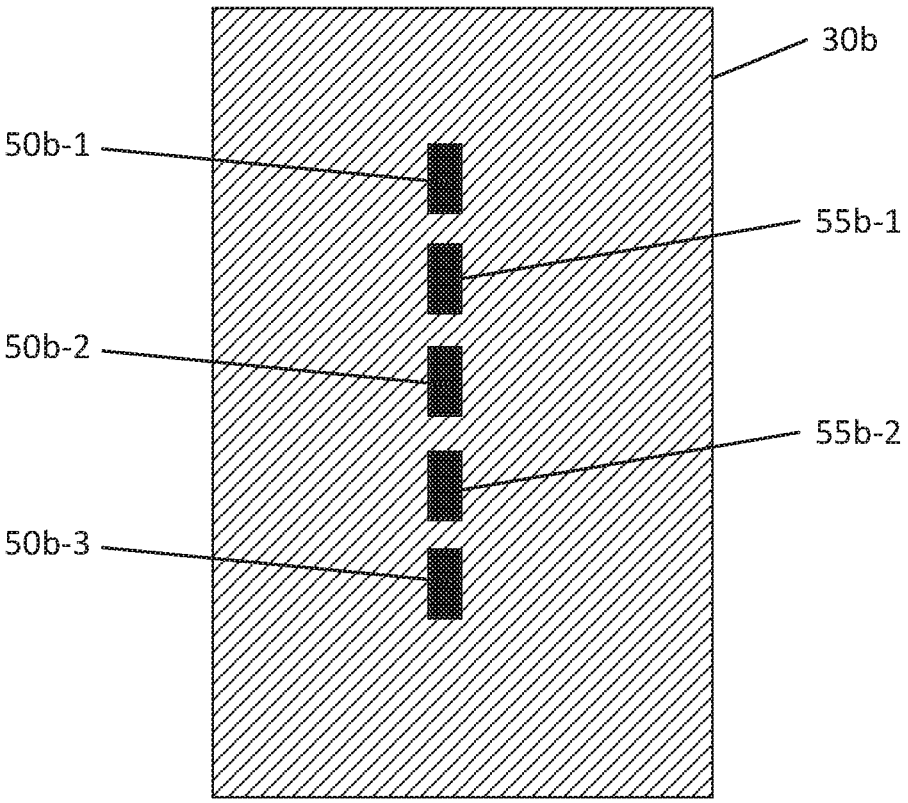
FIG. 6 is a view of the textile after the health spitting procedures carried out by the apparatus of FIG. 5A.

Referring to FIG. 6, in the present example, the spit pattern from the apparatus 10*b* is formed in a substantially straight line perpendicular to the travel direction of the textile 30*b* and the print media (not shown). In the present example, the spit pattern includes spots 50*b*-1, 50*b*-2, 50*b*-3, 55*b*-1, and 55*b*-2. It is to be understood that by forming the spit pattern into a substantially straight line may serve to reduce the amount of textile 30*a* used during the health spitting procedure for the printhead dies 20*b* and the printhead dies 25*b*. In particular, since the width of the textile 30*a* used in the health spitting procedure of the printhead dies 20*b* and the printhead dies 25*b* is limited to the width of the spots 50*b* and the spots 55*b*, the subsequent health spitting procedure may be carried out adjacent to the line formed by the spots 50*b* and the spots 55*b*. For example, if it were to be assumed that that the offset distance is about 10 mm and the width of the spots 50*b* and the spots 55*b* are about 4 mm each, the apparatus 10*b* reduces the amount of textile 30*b* used by up to about 60 percent compared with a process where the printhead dies 20*b* and the printhead dies 25*b* carry out the health spitting simultaneously or without any movement of the textile 30 between their respective health spitting procedures.

Figure 7:
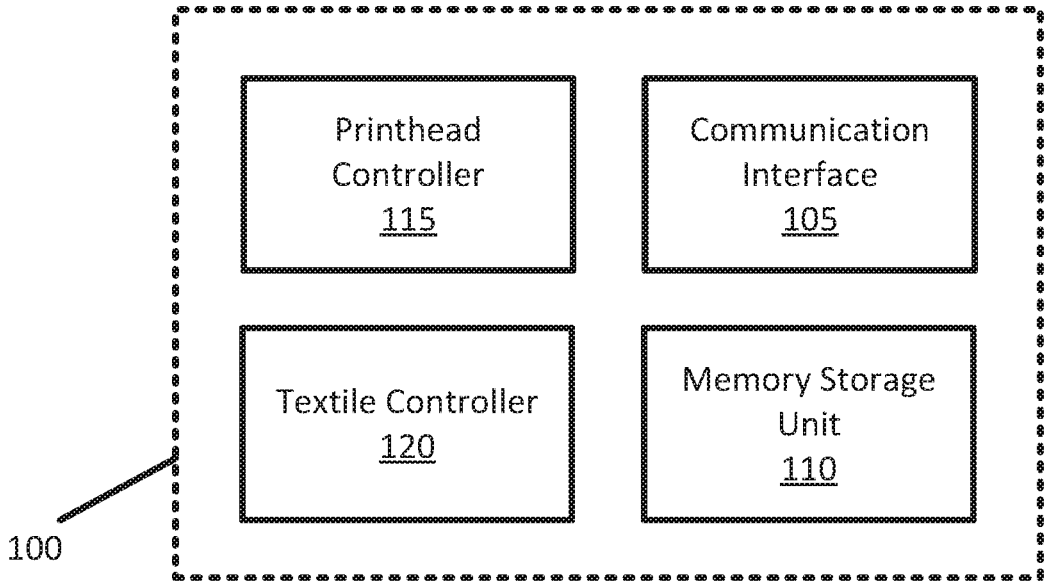
FIG. 7 is a schematic representation of the example controller of the apparatus of FIG. 5A.

Referring to FIG. 7, the controller 100 is shown in more detail. In the present example, the controller 100 is in communication with the printhead 15*b* as well as control the movement of the textile 30*b*. In particular, the controller 100 may be in communication valves to control print fluid flow as well as motors to move the printhead 15*b* and the textile 30*b* in accordance with the present example. The controller 100 may include a communications interface 105, a memory storage unit 110, printhead controller 115, and a textile controller 120.

The communications interface 105 is to communicate with an external device to send and receive commands or other data. In the present example, the external device may be the printing device or another device to monitor the health of the printhead dies 20*b* and/or the printhead dies 25*b*. In other examples, the communications interface 105 may communicate with a server to provide health data to the server, such as in examples where the printing device is managed remotely. The manner by which the communications interface 105 sends and receives data is not limited and may include sending and receiving an electrical signal via a wired connection. For example, the communications interface 105 may be connected to the printing device in examples where the apparatus 10*b* is part of the printing device, such as part of an onboard maintenance system. In other examples, the communications interface 105 may send and receive wireless signals such as via a Bluetooth connection, radio signals or infrared signals from the scanning device. In further examples, the communications interface 105 may be a network interface for communicating over a local area network or the Internet where the communications interface 105 may communicate with a remote server.

The memory storage unit 110 may include a non-transitory machine-readable storage medium that may be any electronic, magnetic, optical, or other physical storage device. In the present example, the memory storage unit 110 may store an operating system that is executable to provide general functionality to the apparatus 10*a*, for example, to support various applications. Examples of operating systems include Windows™, macOS™, iOS™, Android™, Linux™, and Unix™. The memory storage unit 110 may additionally store instructions executable by the printhead controller 115 to operate the printhead 15*b*, as well as the textile controller 120 to coordinate movement of the textile relative to the printhead 15*b*.

In the present example, the memory storage unit 110 may also maintain a database to store a maintenance history the printhead dies 20*b* and the printhead dies 25*b*. For example, a log of the last health spit procedure carried out on each printhead die 20*b* and each printhead die 25*b*.

The printhead controller 115 is to control the printhead 15*a*. In particular, the printhead controller 115 may be to direct the printhead dies 20*b* and the printhead dies 25*b* to carry out a healthy spitting procedure by ejecting print fluid. The printhead controller 115 may also be used to move the printhead 15*b* within the printing device. For example, the printhead controller 115 may be used to position the printhead 15*b* above the textile 30*b* as well as to operate the printhead during normal printing operations.

The printhead controller 115 is to control the printhead 15*a*. In particular, the printhead controller 115 may be to direct the printhead dies 20*b* and the printhead dies 25*b* to carry out a healthy spitting procedure by ejecting print fluid. The printhead controller 115 may also be used to move the printhead 15*b* within the printing device. For example, the printhead controller 115 may be used to position the printhead 15*b* above the textile 30*b*. In other examples, the printhead controller 115 may be the same controller used to control the printhead during normal printing operations.

Figure 8:
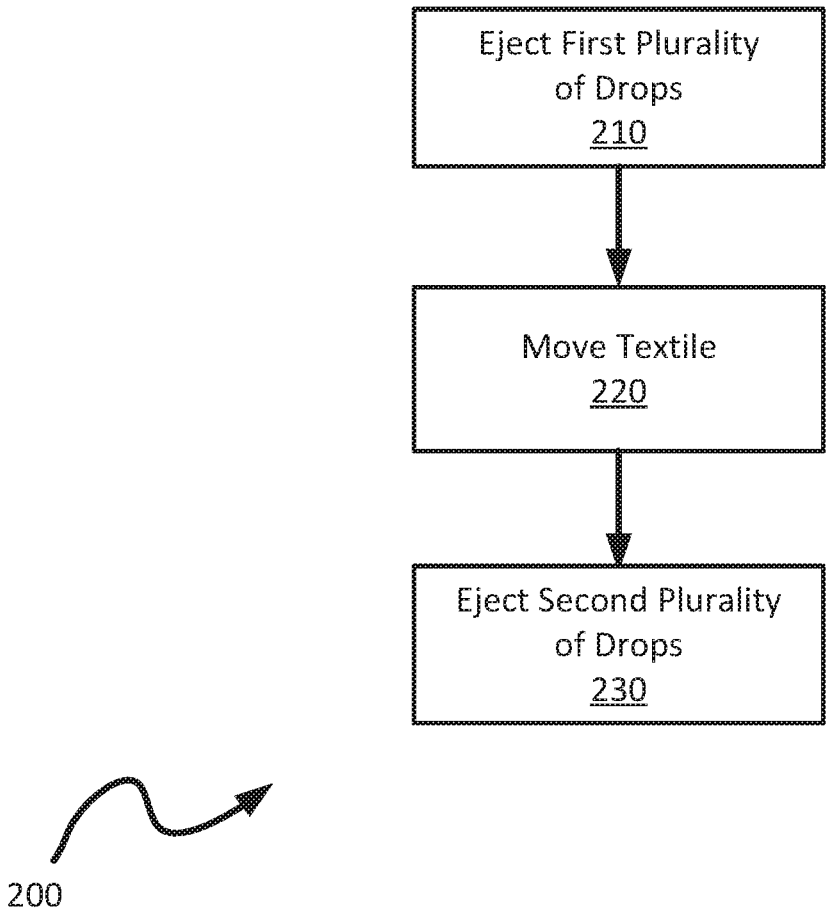
FIG. 8 is a flowchart of an example of a method of reducing textile use during health spitting procedures of a printhead.

Referring to FIG. 8, a flowchart of a method of reducing textile use during health spitting procedures is shown at 200. In order to assist in the explanation of method 200, it will be assumed that method 200 may be performed with the apparatus 10. Indeed, the method 200 may be one way in which apparatus 10 is used and the following discussion of method 200 may lead to a further understanding of the apparatus 10 along with its various components.

Referring to block 210, the nozzle 20 may be used to eject a plurality of drops onto the textile 30. The plurality of drops may be ejected as part of a health spitting process to clean the nozzle 20. In some examples, the nozzle 20 may be further cleaned after the ejection of the drops of print fluid using a mechanical process such as contacting the textile 30 to the nozzle 20 to effectively wipe the nozzle 20 clean of additional residue.

Block 220 comprises moving the textile 30 by an offset distance. In the present example, the offset distance is the same as the distance that the nozzle 20 and the nozzle 25 are offset in the direction of travel as shown as the value x in FIG. 2A. It is to be appreciated that by moving the textile 30 by the offset distance, the nozzle 25 is to be positioned to eject droplets along the same line that the nozzle 20 deposited the ejected drops. The manner by which the textile 30 is moved is not particularly limited. For example, the textile 30 may be moved by having a motor attached to a dispenser roll and a collector roll such that the textile 30 may be moved in one dimension to expose clean portions and to eventually collect used portions of the textile 30.

Referring to block 230, the nozzle 25 may be used to eject a plurality of drops onto the textile 30 after the movement in block 220. The plurality of drops may be ejected as part of a health spitting process to clean the nozzle 25 similar to the process for the nozzle 20 in block 210. In some examples, the nozzle 25 may be further cleaned after the ejection of the drops of print fluid using a mechanical process such as contacting the textile 30 to the nozzle 25 to effectively wipe the nozzle 25 clean of additional residue.

It should be recognized that features and aspects of the various examples provided above may be combined into further examples that also fall within the scope of the present disclosure.

What is claimed is:

1. An apparatus comprising:

a printhead to dispense a first print fluid and a second print fluid;

a first nozzle disposed on the printhead, wherein the first nozzle is to eject a first plurality of drops of the first print fluid;

a second nozzle disposed on the printhead, the second nozzle offset from the first nozzle by an offset distance along a relative direction of media travel, wherein the second nozzle is to eject a second plurality of drops of the second print fluid; and a textile to receive the first plurality of drops and the second plurality of drops, wherein the textile is to be moved relative to the printhead by the offset distance between ejection of the first plurality of drops and the second plurality of drops.

2. The apparatus of claim 1, wherein the textile is to contact the first nozzle after the ejection of the first plurality of drops.

3. The apparatus of claim 2, wherein the textile is to contact the second nozzle after the ejection of the second plurality of drops.

4. The apparatus of claim 1, wherein the ejection of the first plurality of drops and the second plurality of drops generates a spit pattern in a straight line.

5. The apparatus of claim 4, wherein the straight line is at least about 1 mm wide.

6. The apparatus of claim 5, wherein the straight line is at least about 4 mm wide.

7. The apparatus of claim 1, further comprising a dispenser to dispense the textile.

8. The apparatus of claim 7, further comprising a collector to collect the textile after the textile receives the first print fluid and the second print fluid.

9. A method comprising:

ejecting a first plurality of drops of a first print fluid from a first nozzle onto a textile;

moving the textile an offset distance, wherein a second nozzle is offset from the first nozzle by the offset distance along a relative direction of media travel, wherein the first nozzle and the second nozzle are disposed on a printhead to dispense the first print fluid and a second print fluid; and ejecting a second plurality of drops of the second print fluid from the second nozzle onto the textile, wherein the textile is moved relative to the printhead by the offset distance between ejecting the first plurality of drops and the second plurality of drops.

10. The method of claim 9, further comprising contacting the first nozzle with the textile after the ejection of the first plurality of drops.

11. The method of claim 10, further comprising contacting the second nozzle with the textile after the ejection of the second plurality of drops.

12. The method of claim 10, further comprising dispensing the textile from a dispenser such that the first plurality of drops from the first nozzle is to be ejected onto a clean portion of the textile.

13. The method of claim 10, wherein moving the textile comprises dispensing the textile from a dispenser.

14. An apparatus comprising:

a printhead to dispense a print fluid;

a first plurality of dies disposed on the printhead along a first line perpendicular to a direction of media travel, wherein each die of the first plurality of dies is to eject the print fluid;

a second plurality of dies disposed on the printhead along a second line parallel to the first line, wherein the first line is offset from the second line, and wherein each die of the second plurality of dies is to eject a print fluid; and a textile to receive the print fluid ejected from the first plurality of dies and the second plurality of dies, wherein the textile is to be moved by an offset distance between ejection of the print fluid by the first plurality of dies and the second plurality of dies.

15. The apparatus of claim 14, wherein the textile is to contact the first plurality of dies and the second plurality of dies after the ejection of the print fluid.

* * * * *